United States Patent [19]

Hayes

[11] 4,374,646

[45] Feb. 22, 1983

[54] PROCESS OF MAKING AN IMPROVED COMBUSTIBLE GEL AND PRODUCT

[75] Inventor: Edward O. Hayes, Mesa, Ariz.

[73] Assignee: National Research Development, Inc., Scottsdale, Ariz.

[21] Appl. No.: 145,305

[22] Filed: Apr. 30, 1980

[51] Int. Cl.[3] ..... C10L 7/00

[52] U.S. Cl. ..... 44/7 D; 252/315

[58] Field of Search ..... 44/7 D; 423/441; 252/315

[56] References Cited

FOREIGN PATENT DOCUMENTS 6339 of 1901 Austria ..... 48/217

*Primary Examiner*—Bernard Helfin

*Attorney, Agent, or Firm*—Cushman, Darby & Cushman

[57] ABSTRACT

A slow burning combustible gel is prepared by saturating an alkaline earth metal carbide with a lower alkylene glycol for a time sufficient for the ingredients to form the gel.

4 Claims, 1 Drawing Figure

PROCESS OF MAKING AN IMPROVED COMBUSTIBLE GEL AND PRODUCT

FIELD OF THE INVENTION

This invention relates to a process of producing an improved combustible gel fuel of high BTU content, and the product. The product is similar, in some respects to the well known cooking-fuel "Sterno" which is an alcohol base gel.

BACKGROUND OF THE INVENTION

While Sterno is a cooking fuel that has dominated the market for many years, it is relatively expensive to produce and is consumed rather rapidly.

Accordingly, it is an object of this invention to provide an improved, simple and inexpensive process for producing an improved combustible gel fuel.

It is another object of this invention to provide an improved combustible gel fuel that burns with a flame hotter than that of alcohol base gel fuels and for a longer time for the same weight of fuel.

Other objects and advantages of the invention will become apparent from the following detailed descriptions.

BRIEF SUMMARY OF THE INVENTION

The process generally involves saturating (e.g. by soaking) particles (such as small pellets or granules) of an alkaline earth metal carbide, preferably calcium carbide, with a lower alkylene glycol, preferably ethylene glycol, for a time sufficient for the ingredients to form a slow burning combustible gel.

BRIEF DESCRIPTION OF THE DRAWINGS

The drawing is a schematic representation of the process for generating the slow-burning combustible gel.

DETAILED DESCRIPTION OF THE INVENTION

Figure 1:
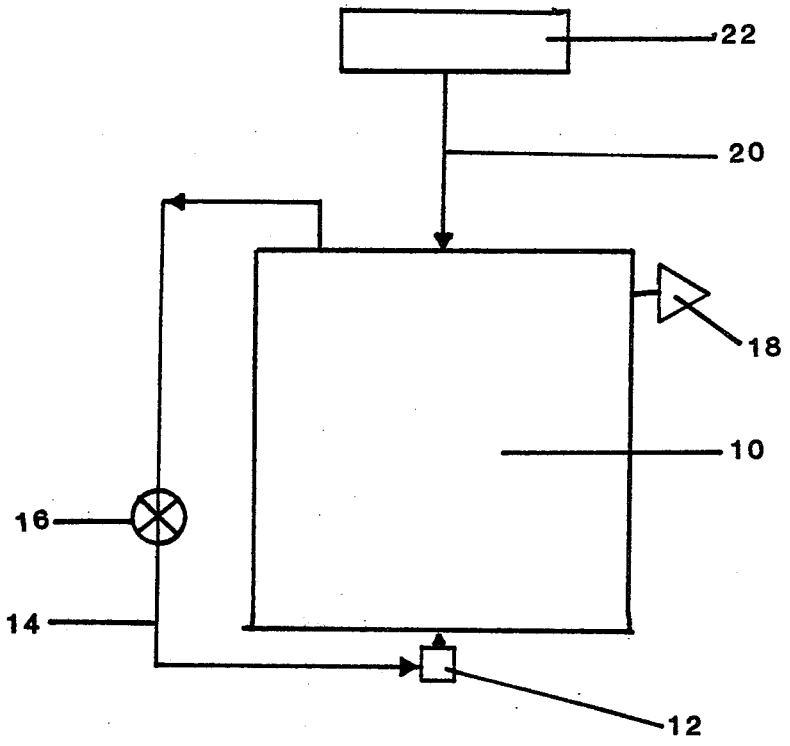

In one embodiment of the process, an impermeable non-corrodable container, e.g. of a suitable plastic, having an air-tight removable closure is filled with small pellets or granules of calcium carbide and ethylene glycol is added to completely cover the carbide. The closure is then applied and the ingredients allowed to react. After a period of time the contents of the container will be converted into a brown-grayish relatively firm gel which can be ignited and burns with a clear blue flame, without smoke or soot, in air. The flame is hotter than that produced by the burning of an alcohol base gel fuel, and on a weight basis the gel fuel of this invention burns longer than an alcohol base gel fuel.

It appears that commercial ethylene glycol contains a small amount of water which reacts slowly with the calcium carbide to produce an acetylene base gas, somewhat in the manner disclosed in my copending application Ser. No. 145,304 filed Apr. 30, 1980, and entitled "Process for Producing an Acetylene Base Fuel Gas." It would seem that the by-product of the reaction and any unreacted carbide dissolve in the ethylene glycol to form a gel which absorbs the gas in large quantities. The greater the proportion of ethylene glycol in the mixture, the less firm the gel, and vice-versa. To speed the process, it is desirable to provide a sealed gas passage connecting the interior of the container at the top with the interior at the bottom so that any gas generated will recirculate from top to bottom and bubble up through the components of the mixture to speed the process and make the conversion to gel more uniform throughout the mixture.

Since the gas generated in the process is rather rapidly absorbed, the process operates under low pressure, so that there is no necessity for a high-pressure reactor. It also appears that the process could be speeded by bubbling a gas, generated in accordance with the disclosure of my aforesaid copending application, through the mixture of calcium carbide and ethylene glycol, until conversion to a combustible gel is complete.

While ethylene glycol is the preferred lower alkylene glycol, others can be used, e.g., propylene glycol; 1,3-propanediol; meso-2,3-butanediol; 1,4-butanediol; glycerol; (1,2,3-propanetriol); cis-1, 2-cyclopentanediol and 2-methyl-1,3-pentanediol.

The following examples are offered in order to more fully illustrate the present invention but are not to be construed as limiting the scope thereof.

EXAMPLE ONE

With particular reference to the drawing, 100 gallons of ethylene glycol are placed in a stainless steel reactor 10 fitted with a backpressure valve 12 in connection with a recirculating line 14, optionally fitted with an incline recirculating pump 16. The reactor 10 may also be fitted with a gas bleed safety valve 18 and load line 20 by which 750 pounds of solid calcium carbide particles may be fed through a metering means 22 to the ethylene glycol in reactor 10. Alternatively, the calcium carbide may be placed in reactor 10 with the glycol and the system closed for a period of 3 days during which time the combustible gel is formed.

During formation of the gel, gas generated is recycled from the top of reactor 10 through line 14 and returned to the reactor by bubbling through the reactor bottom by means of a back pressure valve 12.

It thus will be seen that the objects and advantages of this invention have been fully and effectively achieved. It will be realized, however, that the foregoing specific embodiment as been disclosed only for the purpose of illustrating the principles of this invention and is susceptible of modification without departing from such principles. Accordingly, the invention includes all embodiments encompassed within the spirit and scope of the following claims.

I claim:

1. A process for making a combustible gel comprising soaking calcium carbide in a lower alkylene glycol which contains a small amount of water in a closed space in amounts sufficient and for a time sufficient to produce the gel.

2. A process according to claim 1 in which the glycol is ethylene glycol.

3. A process according to claim 1 in which a gas slowly generated by the reaction of the water with the carbide is recirculated through he mixture of the carbide and the glycol.

4. A combustible gel produced by the process of claim 1 or 2.

* * * * *